US006493999B2

(12) United States Patent
Lindgren et al.

(10) Patent No.: US 6,493,999 B2
(45) Date of Patent: Dec. 17, 2002

(54) ROOF WINDOW WITH AN IMPROVED SECURING DEVICE

(75) Inventors: Claes Lindgren, Farum (DK); Birgitte Hansen, Valby (DK); Samuel Howard Darmer, Greenwood, SC (US); Morten Falk, Copenhagen (DK); Lars Erdmann, Copenhagen (DK)

(73) Assignee: VKR Holding A/S, Soborg (DK)

( * ) Notice: Subject to any disclaimer, the term of this patent is extended or adjusted under 35 U.S.C. 154(b) by 0 days.

(21) Appl. No.: 09/803,643

(22) Filed: Mar. 12, 2001

(65) Prior Publication Data

US 2002/0095883 A1 Jul. 25, 2002

(30) Foreign Application Priority Data

Jan. 19, 2001 (DK) ..... 2001 00102

(51) Int. Cl.[7] ..... E04B 7/18
(52) U.S. Cl. ..... 52/200; 49/386
(58) Field of Search ..... 52/200, 72; 49/386, 49/387

(56) References Cited

U.S. PATENT DOCUMENTS

| | | | | |
|---|---|---|---|---|
| 2,810,153 | A | * | 10/1957 | Semar |
| 3,516,210 | A | | 6/1970 | Jentoft |
| 4,862,657 | A | * | 9/1989 | Jentoft et al. |
| 4,986,039 | A | * | 1/1991 | Weisner |
| 5,103,603 | A | * | 4/1992 | Verby et al. |
| 5,148,643 | A | * | 9/1992 | Sampson et al. |
| 5,207,036 | A | * | 5/1993 | Sampson et al. |
| 5,394,649 | A | | 3/1995 | Lindgren et al. |
| 5,533,234 | A | * | 7/1996 | Bizek |
| 5,669,186 | A | * | 9/1997 | Verby et al. |
| 6,202,373 | B1 | | 3/2001 | Lindgren |

FOREIGN PATENT DOCUMENTS

| | | | | |
|---|---|---|---|---|
| DE | 1003059 | * | 2/1957 | ..... 49/386 |
| DE | 2357019 | * | 5/1975 | ..... 49/386 |
| DE | 2512704 | * | 10/1976 | ..... 49/386 |
| EP | 72320 | * | 2/1983 | ..... 52/200 |
| EP | 0 179 509 | | 4/1986 | |
| FR | 2251696 | * | 6/1975 | ..... 49/386 |
| WO | WO 93/11332 | | 6/1993 | |

* cited by examiner

*Primary Examiner*—Robert Canfield
(74) *Attorney, Agent, or Firm*—Venable; John P. Shannon; Chad C. Anderson

(57) ABSTRACT

The window frame structure of the roof window is secured to the main frame structure within a predetermined range of the opening angle by means of a securing device comprising at least one torsion member. The torsion member is torsionally biased in the opening direction of the window and includes engagement means at a distance from the pivot axis for engagement with corresponding engagement means on the window frame structure. The securing device is automatically activated and deactivated during mounting and dismounting of the window frame from the main frame.

25 Claims, 3 Drawing Sheets

ROOF WINDOW WITH AN IMPROVED SECURING DEVICE

CROSS-REFERENCE TO RELATED APPLICATIONS

The present application claims the benefit of priority from Danish patent application No. PA 2001 00102 filed on Jan. 19, 2001.

FIELD OF THE INVENTION

This invention relates to skylights or roof windows comprising a main frame structure for stationary connection with supporting means of a roof structure, and a window frame structure carrying a glazing element, the main frame and window frame structures having respectively a plurality of members, each of which members extends in a longitudinal direction between a first and a second end; wherein said window frame structure is connected with the main frame structure by means of at least one hinge connection at a respective first member of the main frame and window frame structures to allow the window frame structure to be pivoted about a pivot axis parallel with the longitudinal direction of said first members with respect to the main frame structure to an opening angle, said hinge connection being disengageable to allow the window frame structure to be removed from the main frame structure, said at least one connection including at least one pair of first and second connecting members connected with the main frame and window frame structure, respectively, a securing device being provided for maintaining the engagement between the connecting members of said pairs within a predetermined range of the opening angle of the window frame structure.

BACKGROUND OF THE INVENTION

For reasons of installation conditions, it is often desirable to install such windows in an inclined roof surface by initial securing of the main frame of the window, from which the glass-carrying window frame has been detached, to the roof supporting structure. Following this operation the window frame structure is hatched on to the main frame structure by bringing the connecting members of the window frame into engagement with the connecting members of the main frame. Evidently, it is essential that the window frame structure is properly secured against unintentional removal from the main frame structure.

In its most simple form such securing may be achieved by making the connection between the connecting members of the main frame structure and the window frame structure permanent following the initial engagement operation.

However, it is often desirable to retain the possibility of disengaging the connection between the window frame and the main frame, eg. for maintenance purposes.

WO 93/11332 discloses a window, in which securing means are provided for retaining the engagement between the connecting members of the window frame and the main frame, said means comprising a block which may be displaced in a groove in a side member of the window frame and which may serve partly as an anchoring element for a locking member fastened in the main frame structure of a fixed window, partly for releasable coupling with an operating member of a window operator in the case of an openable window. This solution suffers from the drawback that the securing means are dependent on a particular design of the operator in order to provide proper functioning.

In the window disclosed in WO 98/22685 the securing means are constituted by holding means fastened to the side members of the window frame structure at a comparatively short distance from the pivot axis. The holding means include blocks with part-cylindrical guide surfaces having an axis in the pivot axis of the hinge. Due to the position close to the pivot axis, these blocks are subjected to rather heavy load during opening of the window frame.

BRIEF SUMMARY OF THE INVENTION

It is an object of the invention to provide a roof window in which the conditions with respect to initial mounting and subsequent dismounting of the window frame structure are improved even further.

It is a further object of the invention to provide a roof window which has a less complex design compared to prior art window designs.

These objects are met by the provision of a roof window of the initially stated kind, in which said securing device includes at least one torsion member positioned at a respective end of said first members of the main frame and window frame structures, said at least one torsion member being torsionally biased in the opening direction of the window frame structure with respect to the main frame structure and including engagement means for engagement with corresponding engagement means positioned at a distance from said pivot axis along a second window frame member adjacent said first member of the window frame structure within said predetermined range of the opening angle.

By the incorporation of a torsion member which follows the movement of the window frame structure during opening of the window within the predetermined range of the opening angle, in which the securing device is active, the activation and deactivation of the securing device is effected automatically. In addition to providing security against unintentional removal of the window frame, the torsion member assists the pivotal movement of the window frame structure from the closed position to a ventilating position.

In another aspect of the invention a securing device for maintaining the engagement between connecting members of a main frame structure and a window frame structure of an openable roof window within a predetermined range of the opening angle of the window frame structure is provided, said securing device including at least one torsion member to be connected with of the window, said at least one torsion member being torsionally biased in the opening direction of the window frame structure with respect to the main frame structure and including engagement means for engagement with corresponding engagement means to be positioned on the window frame structure.

Further details and advantages will readily be appreciated from the appended drawings and the detailed description to follow.

BRIEF DESCRIPTION OF THE SEVERAL VIEWS OF THE DRAWING

Embodiments of the invention will now be described in more detail with reference to the schematic drawings, in which.

DETAILED DESCRIPTION OF THE INVENTION

Figure 1:
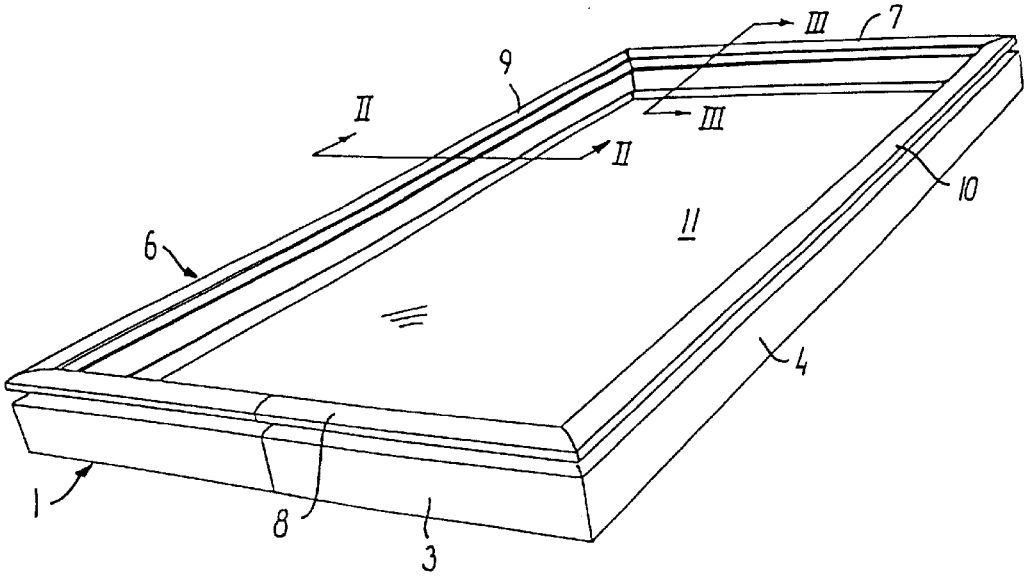
FIG. 1 shows a perspective view of an embodiment of a roof window according to the invention.
Figure 2:
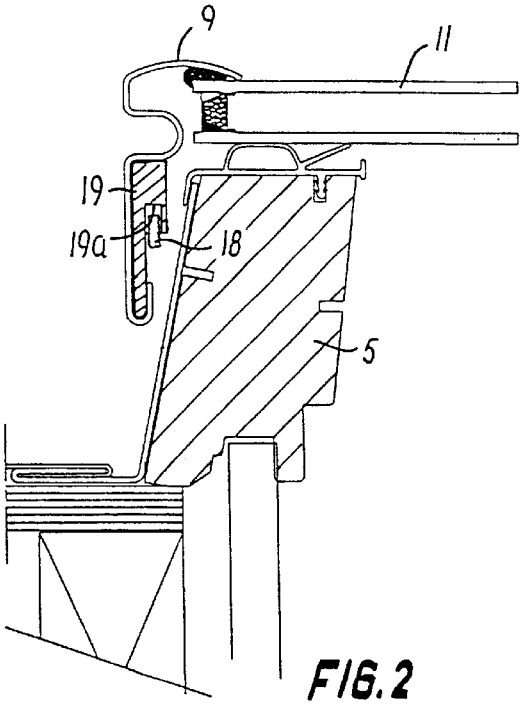
FIG. 2 shows a cross-sectional view along the line II—II in FIG. 1.

The roof window illustrated in the Figures comprises a main frame structure generally designated 1 and having in the embodiment shown a top member 2, a bottom member 3 and two side members 4, 5. The roof window is intended to be installed in a roof surface, in a manner known per se, by stationarily connecting the main frame structure 1 to the roof structure by means of any suitable supporting means, eg. mounting brackets secured to the main frame side members 4, 5.

Figure 3:
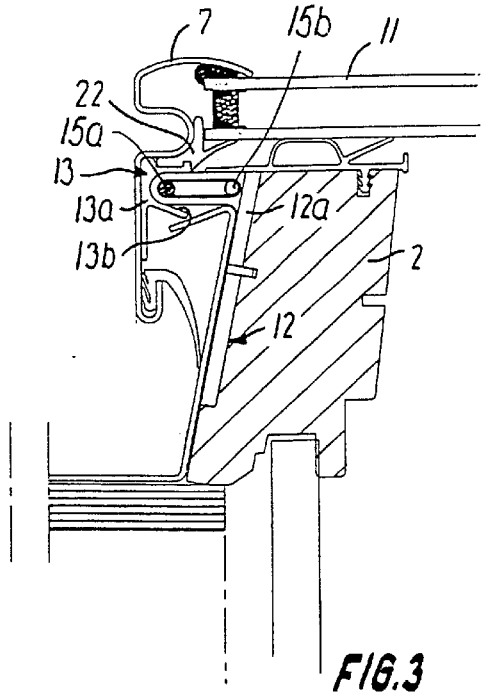
FIG. 3 shows a cross-sectional view along the line III—III in FIG. 1.
Figure 4:
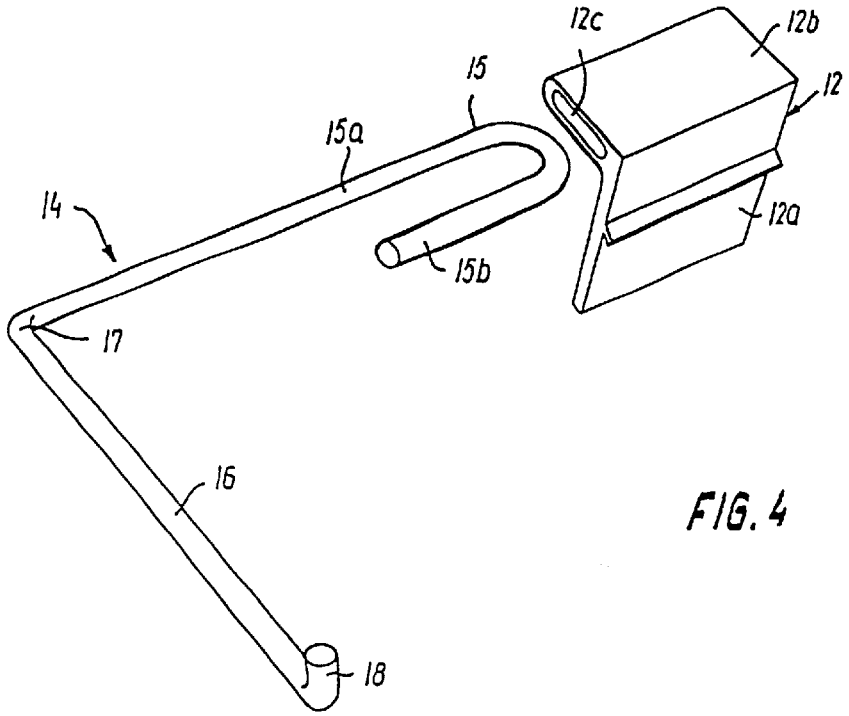
FIG. 4 shows an exploded perspective view of a detail of an embodiment of the roof window according to the invention.

A window frame structure generally designated 6 and having a top member 7, a bottom member 8 and side members 9, 10 encasing a glazing element 11 is in the embodiment shown connected with the main frame structure 1 at the respective top members 7 and 2 by means of a hinge connection which in the embodiment shown comprises two pairs of first and second connecting members 12, 13 shown in FIG. 3. In the following description, the elements of one of the pairs only will be referred to. It should be remarked that the elements of the other pair are designed in substantially corresponding manner. The first connecting member 12 is secured in a transverse groove-like depression of the main frame top member 2 by means of an elongate flange part 12*a* formed integrally with a projecting elongate engagement part 12*b* which is received in a corresponding engagement part in the form of a substantially V-shaped track 13*b* of the second connecting member 13 which in turn is secured to the window frame top member 7 by a flange portion 13*a*. The engagement parts 12*b*, 13*b* are formed with a respective part-cylindrical engagement surface to define a pivot axis of the window frame structure 6 with respect to the main frame structure 1. The V-shaped track 13*b* is formed with an included angle in the range from 20° to 30° corresponding to the desired range of opening angle in which the window is operative.

In order to maintain the engagement between the connecting members 12, 13 during opening of the window frame structure 6 with respect to the main frame structure 1, a securing device is provided. The securing device comprises a torsion member 14 positioned at a respective end of the top members 2, 7 of the main frame and window frame structures 1, 6. Means are provided at a distance from the pivot axis defined by the engagement surfaces of the connecting members 12, 13 along each side of the window frame for keeping the window frame structure 6 in releasable engagement with the torsion member 14 within said predetermined range of the opening angle, which torsion member 14 is in turn secured to the main frame structure. In the embodiment shown, the torsion member 14 includes a first arm 15 and a second arm 16 extending substantially perpendicularly to each other originating from a connecting point 17. For reasons set forth in the following, it is preferred that the connecting point 17 is positioned substantially on the pivot axis of the window.

In the embodiment shown in FIGS. 2 to 7, the first arm 15 comprises two mutually spaced and substantially parallel limbs 15*a*, 15*b* forming at the end opposite said connecting point 17 a narrow elongated U and is received in a longitudinal channel 12*c* of elongate cross-section formed in the engagement part 12*b* of the first connecting member 12. At the end of the second arm 16 opposite said connecting point 17 engagement means in the form of an upstanding pin 18 are provided. The upstanding pin 18 is releasably connected with corresponding engagement means positioned on the adjacent window frame side member 9, 10 and comprising a block 19 having a recess 19*a*.

Figure 8:
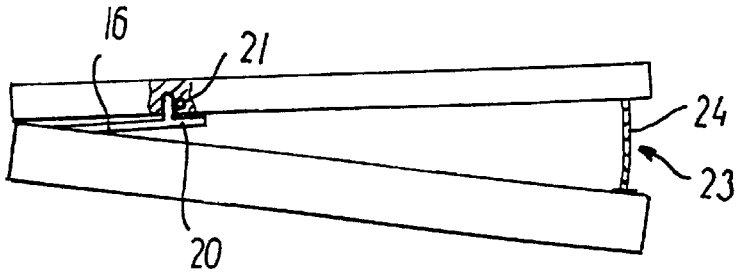
FIG. 8 is a view corresponding to FIG. 7 of an alternative embodiment of the roof window.

In the alternative embodiment of the engagement means of the torsion member 14 and of the window frame structure, respectively, shown in FIG. 8, the engagement means of the second arm 16 of the torsion member 14 includes a fork portion 20 and the corresponding engagement means of the window frame side member 9, 10 includes a protruding pin 21 which is received in the fork portion 20 within said predetermined range of the opening angle.

Figure 5:
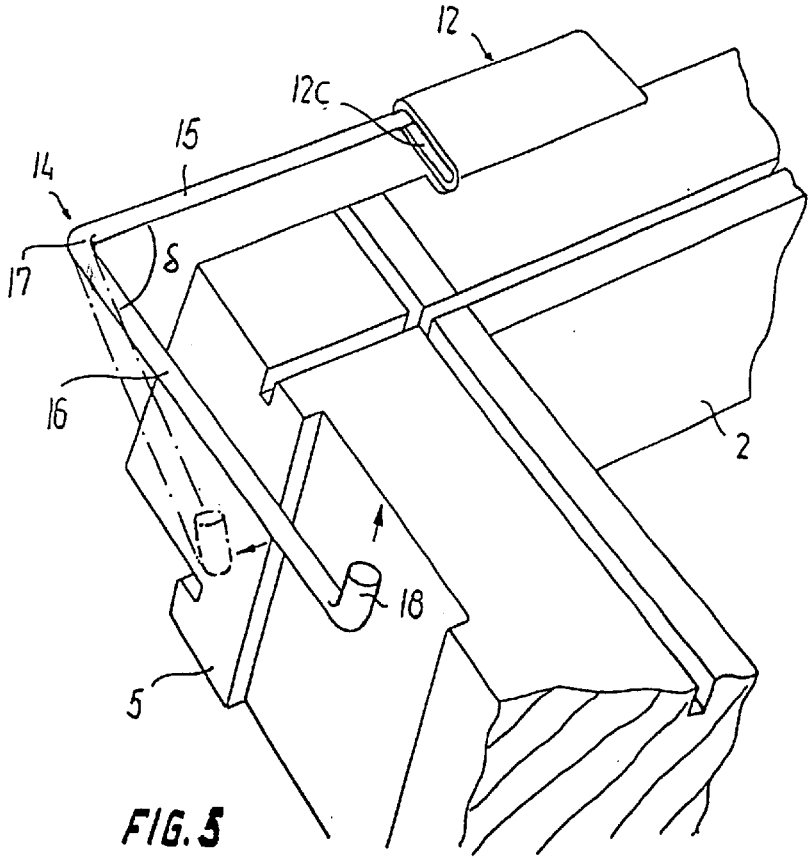
FIG. 5 shows a perspective view of a detail of an embodiment of the roof window according to the invention.

In each of the above cases, the torsion member 14 is torsionally biased in the opening direction of the window frame structure 6 with respect to the main frame structure 1. Within the predetermined opening angle of the window frame structure, the upstanding pin 18 is thus received in the recess 19*a* in the block 19 on the window frame side member 9, or, in the alternative embodiment of FIG. 8, the protruding pin 21 abuts the fork portion 20. Consequently, by turning about the connecting point 17, the second arm 16 of the torsion member 14 follows the pivoting movement of the window frame structure during opening of the window until the torsion member 14 reaches its relaxed condition which may be chosen according to the desired predetermined range of the opening angle. The spring bias is illustrated in FIG. 5, the second arm 16 in the absence of physical load thus assuming the position indicated by the dot-and-dash line, in which the second arm 16 extends in a direction forming an angle with the plane defined by the first arm 15.

Figure 9:
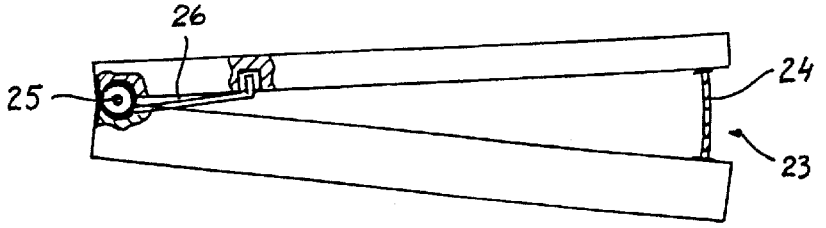
FIG. 9 is a view corresponding to FIG. 7 of a further alternative embodiment of the roof window.

Other designs of the torsion member are of course conceivable, including the further alternative embodiment shown in FIG. 9, in which a torsion member comprising a coil spring 25 is connected with the main frame structure. The coil spring 25 acts on a lever 26 in a point of action, preferably situated on the pivot axis of the window frame structure, at one end of the lever and engagement means are provided at the opposite end. The engagement means may as shown be designed as in the embodiment of FIG. 7, or, alternatively, as in the FIG. 8 embodiment.

It is preferred that one torsion member is positioned at a respective end of the top members of the main frame and window frame structures. However, it is conceivable that only one torsion member is utilized.

Figure 7:
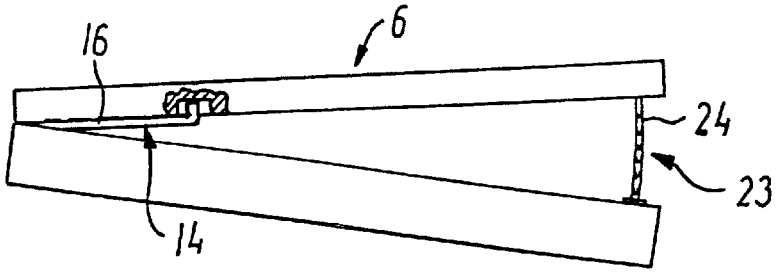
FIG. 7 shows a side view, partially sectioned, of the roof window of FIG. 6 in a ventilating position within the predetermined range of opening angle.

Installation of a roof window according to the invention may thus be performed in the following manner:

The main frame structure 1 is secured to the roof surface by appropriate supporting means. Following this operation, the window frame structure 6 is positioned in such a way that the window frame top member 7 is positioned above the main frame top member 2 so that the window frame structure 6 rests on the first connecting member 12 by its glazing element 11, the window frame structure forming an angle with the main frame structure. The connecting members 12, 13 of each of the pairs forming the hinge connection are brought into mutual engagement by pulling the window frame structure 6 in the direction of the main frame bottom member 3, the window frame structure 1 now sliding on the first connecting member 12 by a guide member 22 (shown in FIG. 3) provided in the window frame top member 7. As soon as the contact between the engagement surfaces of the connecting members 12, 13 has been established, the window frame structure 6 is turned in the closing direction about the pivot axis at the top members 2, 7, and the securing device is automatically activated, as illustrated in FIG. 7, as the upstanding pin 18 is received in the recess 19*a* in the block 19, alternatively as the protruding pin 21 is engaged in the fork portion 20.

Figure 6:
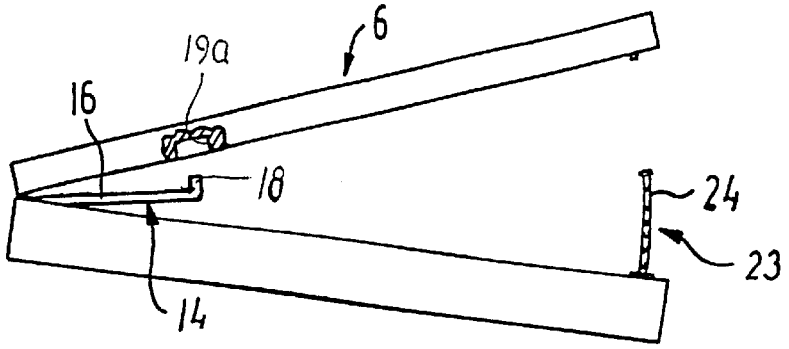
FIG. 6 shows a side view, partially sectioned, of an embodiment of the roof window.

The installation process is facilitated by the feature indicated in FIG. 5, from which it appears that the spring bias of the torsion member 14 is dimensioned such that in the absence of physical load, the second arm 16 will form an angle δ with the first arm 15, which is slightly bigger than 90°. In result, by turning the window frame 6 beyond the range of ventilating positions, ie. to a position as shown in FIG. 6, the second arm 16 will project outwards below the lower edges of the side members 9, 10 of the window frame 6.

In view of the fact that the engagement between connecting members 12 and 13 of the main frame and window frame structures is open-ended at either end, the torsion member 14 thus provides a useful guide means assisting to secure accurate positioning of the window frame structure 6 with respect to the main frame structure 1 when the window frame structure is pivoted into a position within the predetermined ventilating range.

Correspondingly, the lever 26 of the embodiment of FIG. 9 may be directed slightly outwards with respect to the longitudinal direction of the adjacent window frame side members.

The window frame structure 6 may now be brought to its closed position without any risk of disengaging the connecting members 12, 13 from each other. Operation of the window, ie. opening the window frame structure to a ventilating position, may be carried out by means of a window operator 23 mounted at the bottom member 3 of the main frame structure. Preferably, the window operator is an electrically operated chain operator including an operating chain 24 detachably connected with the bottom member 8 of the window frame structure. The operative length of the operating chain 24 is chosen such that it is only possible to open the window by means of the operator to a maximum ventilating position falling within the predetermined range of the opening angle, in which the securing device is active. In order to remove the window frame structure 6 from the main frame structure 1, the operating chain 24 is released from the window frame bottom member 8 and the window frame structure 6 is pivoted further about its pivot axis, whereby the engagement means on the torsion member, as shown in FIG. 6, are released from the engagement with the corresponding engagement means on the window frame structure.

The invention should not be regarded as being limited to the embodiments described in the above but various modifications and combinations of the shown embodiments may be carried out without departing from the scope of the following claims.

For instance, other geometrical configurations of the main frame and window frame structures than the rectangular shape shown and described in the above are conceivable. Furthermore, the hinge connection may be positioned arbitrarily in the skylight or roof window to provide a pivot axis at eg. a bottom or side member.

What is claimed is:

1. A roof window comprising:

a main frame structure for stationary connection with supporting means of a roof structure, and a window frame structure carrying a glazing element, the main frame and window frame structures having respectively a plurality of members, each of which members extends in a longitudinal direction between a first and a second end; wherein said window frame structure is connected with the main frame structure by means of at least one hinge connection at a respective first member of the main frame and window frame structures to allow the window frame structure to be pivoted about a pivot axis parallel with the longitudinal direction of said first members with respect to the main frame structure to an opening angle, said hinge connection being disengageable to allow the window frame structure to be removed from the main frame structure, said at least one connection including at least one pair of first and second connecting members connected with the main frame and window frame structure, respectively, a securing device being provided for maintaining the engagement between the connecting members of said pairs within a predetermined range of the opening angle of the window frame structure;

said securing device including at least one torsion member positioned at a respective end of said first members of the main frame and window frame structures, said at least one torsion member being torsionally biased in the opening direction of the window frame structure with respect to the main frame structure and including engagement means for engagement with corresponding engagement means positioned at a distance from said pivot axis along a second window frame member adjacent said first member of the window frame structure within said predetermined range of the opening angle.

2. A roof window as claimed in claim 1, wherein said at least one torsion member includes a first and a second arm extending substantially perpendicularly to each other originating from a connecting point, the first arm being secured to said first main frame member and extending along the longitudinal direction thereof, and said engagement means being provided at the end of the second arm opposite said connecting point for releasable connection with the corresponding engagement means positioned on said second window frame member within said predetermined range of the opening angle.

3. A roof window as claimed in claim 2, wherein said first arm comprises two mutually spaced and substantially parallel limbs forming at the end opposite said connecting point a narrow elongated U.

4. A roof window as claimed in claim 3, wherein the engagement means of the second arm of said torsion member includes an upstanding pin and the corresponding engagement means of said second window frame member includes a block having a recess, said upstanding pin being received in said recess within said predetermined range of the opening angle.

5. A roof window as claimed in claim 3, wherein the engagement means of the second arm of said torsion member includes a fork portion and the corresponding engagement means of said second window frame member includes a protruding pin, said protruding pin being received in said fork portion within said predetermined range of the opening angle.

6. A roof window as claimed in claim 1, wherein said at least one torsion member comprises a coil spring connected with the main frame structure and a lever having two ends, said coil spring acting on said lever in a point of action situated at one end and said engagement means being provided at the opposite end.

7. A roof window as claimed in claim 1, including two pairs of first and second connecting members positioned at a distance from each other in the longitudinal direction of the first main frame and window frame members, respectively.

8. A roof window as claimed in claim 7, wherein said first connecting member of each of said pairs comprises an elongate flange part for securing to the first main frame member and a projecting elongate engagement part engageable with a substantially V-shaped track formed in said second connecting member of the same pair.

9. A roof window as claimed in claim 8, wherein said engagement part of the first connecting member and said track in the second connecting member are formed with substantially part-cylindrical engagement surfaces to define the pivot axis of the window frame structure with respect to the main frame structure.

10. A roof window as claimed in claim 9, wherein said V-shaped track is formed with an included angle in the range from 20° to 30° to define a correspondingly limited range of ventilation positions of said window frame structure with respect to said main frame structure.

11. A roof window as claimed in claim 10, wherein said at least one torsion member includes a first and a second arm extending substantially perpendicularly to each other originating from a connecting point, the first arm being secured to said first main frame member and extending along the longitudinal direction thereof, and said engagement means being provided at the end of the second arm opposite said connecting point for releasable connection with the corresponding engagement means positioned on said second window frame member within said predetermined range of the opening angle.

12. A roof window as claimed in claim 11, wherein said first arm comprises two mutually spaced and substantially parallel limbs forming at the end opposite said connecting point a narrow elongated U.

13. A roof window as claimed in claim 12, wherein said engagement part of the first connecting member is formed with a longitudinal channel of elongate cross-section corresponding to the dimensions of the second arm for receiving said first arm of the torsion member.

14. A roof window as claimed in claim 2, wherein the connecting point of the arms of the torsion member is positioned substantially on the pivot axis of the window frame structure.

15. A roof window as claimed in claim 10, wherein said at least one torsion member comprises a coil spring connected with the main frame structure and a lever having two ends, said coil spring acting on said lever in a point of action situated at one end and said engagement means being provided at the opposite end.

16. A roof window as claimed in claim 15, wherein the point of action is positioned substantially on the pivot axis of the window frame structure.

17. A roof window as claimed in claim 1, wherein the window frame structure comprises at least one guide member engaging an edge zone of the glazing element and being formed with a retaining part engaging a respective second connecting member in each of said pairs.

18. A roof window as claimed in claim 1, wherein the main frame and window frame structures have respective second members distant from said first members, the roof window further comprising a window operator for opening the window frame structure to a ventilating position, said window operator being mounted at the second members of the main frame and window frame structures.

19. A roof window as claimed in claim 18, wherein said window operator is an electrically operated chain operator secured to the second member of the main frame structure and including an operating chain detachably connected with the second member of the window frame structure.

20. A securing device for maintaining the engagement between connecting members of a main frame structure and a window frame structure of an openable roof window within a predetermined range of the opening angle of the window frame structure; wherein said securing device includes at least one torsion member to be connected with the window, said at least one torsion member being torsionally biased in the opening direction of the window frame structure with respect to the main frame structure and including engagement means for engagement with corresponding engagement means to be positioned on the window frame structure, wherein said at least one torsion member includes a first and a second arm extending substantially perpendicularly to each other originating from a connecting point, the first arm being intended to be secured to the main frame structure, and said engagement means being provided at the end of the second arm opposite said connecting point for releasable connection with the corresponding engagement means to be positioned on the window frame structure.

21. A securing device as claimed in claim 20, wherein said first arm comprises two mutually spaced and substantially parallel limbs forming at the end opposite said connecting point a narrow elongated U.

22. A securing device as claimed in claim 21, wherein the engagement means of the second arm of said torsion member includes an upstanding pin and the corresponding engagement means to be positioned on the window frame structure includes a block having a recess, said upstanding pin being received in said recess within said predetermined range of the opening angle.

23. A securing device as claimed in claim 21, wherein the engagement means of the second arm of said torsion member includes a fork portion and the corresponding engagement means to be positioned on the window frame structure includes a protruding pin, said protruding pin being received in said fork portion within said predetermined range of the opening angle.

24. A securing device as claimed in claim 20, wherein said at least one torsion member comprises a coil spring connected with the main frame structure and a lever having two ends, said coil spring acting on said lever in a point of action situated at one end and said engagement means being provided at the opposite end.

25. A securing device as claimed in claim 20, wherein said engagement means releases the connecting members of the main frame structure and the window frame structure outside of the predetermined range of the opening angle of the window frame structure.

* * * * *